United States Patent [19]

Lockwood et al.

[11] Patent Number: 5,038,748

[45] Date of Patent: Aug. 13, 1991

[54] SELF-CLEANING GAS RANGE HAVING HEAT BAFFLE ASSEMBLY

[75] Inventors: John W. Lockwood, Louisville, Ky.; Stephen B. Froelicher, Columbus, Ind.

[73] Assignee: General Electric Company, Louisville, Ky.

[21] Appl. No.: 575,114

[22] Filed: Aug. 30, 1990

[51] Int. Cl.[5] ..... A21B 1/00

[52] U.S. Cl. ..... 126/19 R; 126/21 A; 126/41 R

[58] Field of Search ..... 126/19 R, 21 R, 21 A, 126/273 R, 41 R

[56] References Cited

U.S. PATENT DOCUMENTS

| | | | |
|---|---|---|---|
| 3,422,809 | 1/1969 | Perry | 126/21 A |
| 3,480,000 | 11/1969 | Torrey et al. . | |
| 3,624,742 | 11/1971 | Hurko | 126/21 R X |
| 3,915,149 | 10/1975 | Kemp . | |
| 4,598,691 | 7/1986 | Herrelko et al. . | |
| 4,718,400 | 1/1988 | Lotz et al. . | |

OTHER PUBLICATIONS

General Electric Parts Catalog, range Model JGBP24GEF1, pp. 374 and 376 Aug. 1988.

*Primary Examiner*—Larry Jones

*Attorney, Agent, or Firm*—H. Neil Houser; Radford M. Reams

[57] ABSTRACT

A self-cleaning gas range has its frame support an oven with a storage compartment beneath the oven in spaced relation thereto. A burner, which is beneath the oven and above the storage compartment, heats the oven to a temperature to produce self cleaning. A baffle assembly, which is beneath a heat shield beneath the burner and above the storage compartment, prevents the top of the storage compartment from exceeding a predetermined maximum temperature when self cleaning occurs. The baffle assembly includes a bottom baffle of galvanized steel attached to the frame and forming the top of the storage compartment, an intermediate baffle of galvanized steel above the bottom baffle in spaced relation thereto, and an inner baffle of reflecting aluminum above the intermediate baffle in spaced relation thereto with the three baffles assembled to each other. Air passages in the intermediate baffle are not aligned with air passages in the bottom and top baffles so that air flows from beneath the bottom baffle through the air passages in the three baffles in a circuitous path and through openings in the heat shield to the burner. A radiation shield is supported on a brace extending between downwardly extending portions of the oven side walls only by point contacts. Each side wall has louvered openings beneath the first baffle and communicating with an air passage in the side wall so that air flows over the bottom of the first baffle and into the air passages.

20 Claims, 8 Drawing Sheets

SELF-CLEANING GAS RANGE HAVING HEAT BAFFLE ASSEMBLY

FIELD OF THE INVENTION

This invention relates to a heat baffle assembly for a self-cleaning gas range.

BACKGROUND OF THE INVENTION

In a gas range having a self-cleaning oven, a surface immediately beneath a burner, which is beneath the bottom wall of the oven, typically reaches a temperature of 1150° F. to 1200° F. during self cleaning of the oven by the burner being operated for predetermined periods of time. The gas range may have a storage compartment beneath the oven. The American National Standards Institute (ANSI) has a requirement that the top surface of the storage compartment is not to exceed a temperature of 300° F. with an ambient temperature of 72° F. This is to prevent the storage compartment from becoming so hot as to present a fire hazard to stored items.

Each of U.S. Pat. Nos. 3,480,000 to Torrey et al, 3,915,149 to Kemp, and 4,598,691 to Herrelko et al relates to a gas range having a self-cleaning oven. The aforesaid Herrelko et al patent has a burner, which is used to self clean the oven, disposed with a burner box beneath the bottom wall of the oven. A retainer, which forms the top of a storage compartment beneath the burner box, is beneath the bottom wall of the burner box in spaced relation thereto and has a bottom heat shield supported beneath it in spaced relation thereto. The air flows by convection through passages, which are formed between the heat shield and the retainer and between the retainer and the bottom wall of the burner box, and into the burner box, which has insulation around it. While the aforesaid Herrelko et al patent has arrows designating the air flow so that the air apparently flows through openings in the retainer and the bottom wall of the burner box, there is no identification of the openings. There also are no openings in the bottom heat shield so that the bottom heat shield apparently is employed only to prevent radiation of heat into the storage compartment.

Another suggested baffle arrangement for a gas range having a self-cleaning oven has two vertically spaced baffles with a first heat shield therebetween and a second heat shield, which is above the inner baffle of the two baffles and beneath a burner used to produce self-cleaning of the oven. Both of the baffles and both of the heat shields are formed of aluminized steel.

In this arrangement, a bottom baffle, which forms the top of a storage compartment, is spaced from portions of both side walls and a rear wall of the oven of the gas range extending downwardly beneath the bottom wall of the oven to provide spaces therebetween. This enables air to flow upwardly past the bottom baffle through the spaces between the edges of the bottom baffle and the downwardly extending portions of the side walls and the rear wall of the oven. Each of the downwardly extending portions of the side walls of the oven has louvered openings in a plane just beneath the bottom surface of the bottom baffle so that air flows beneath the bottom surface of the bottom baffle into the louvered openings and upwardly through passages, which communicate with the louvered openings, exterior of the side walls of the oven to exit through openings at the top of the range.

The first heat shield is disposed in spaced relation above the bottom baffle by a pair of domes extending downwardly from opposite sides of the first heat shield and into engagement with a pair of domes extending upwardly from the bottom baffle. A screw extends through each pair of the two engaging domes to secure the first heat shield, which is about half the width of the bottom baffle and substantially the same length, to the bottom baffle.

The inner baffle is positioned above the first heat shield in spaced relation thereto through having four hat brackets, which are welded to the inner baffle and extend downwardly therefrom, receive screws extending through the bottom baffle. This not only secures the bottom baffle to the inner baffle but also maintains them in spaced relation. Two additional screws secure the bottom baffle to a frame of the range.

The inner baffle has a plurality of openings in its central portion vertically aligned with openings in the second heat shield, which is above the inner baffle and beneath the gas burner, and with the gas burner to allow air to flow to the gas burner for combustion. The openings in the inner baffle also are in vertical alignment with the first heat shield so that there is no heat radiation to the bottom baffle.

The inner baffle and the second heat shield, which is formed of a plurality of separate parts in the shape of a box without a top and held together by about twenty-four screws, are attached to the frame. Fiberglass insulation surrounds the second heat shield including being disposed between the second heat shield and the inner baffle with only passages in the insulation to allow air flow to the gas burner through the openings in the inner baffle and the second heat shield. There are ten screws to attach the inner baffle and the second heat shield to the frame.

Accordingly, substantial heat transfer by conduction occurs through the areas of the first and second heat shields and the baffles held in engagement with each other by the screws. Furthermore, there is no cooling by convection of the first heat shield, and there is no air flow over the upper surface of the bottom panel to aid in cooling by convection. Additionally, forming the two baffles and the two heat shields of aluminized steel is a significant expense. There also is a significant expense in using insulation between the second heat shield and the inner baffle.

SUMMARY OF THE INVENTION

The present invention reduces the cost of a baffle assembly for a self-cleaning range through not having to form its bottom and intermediate baffles of aluminized steel although its heat shield is formed of aluminized steel and its inner baffle is formed of aluminum. Additionally, the heat baffle assembly of the present invention in conjunction with the heat shield is capable of having air flow by convection over the surfaces of each of the three baffles. This reduces the heat transfer to the bottom baffle while still having the baffles arranged in a relatively compact vertical arrangement. This is accomplished through having the air openings in each of the three baffles arranged so that there is a circuitous flow of air between the openings in the adjacent baffles.

The baffle assembly of the present invention also prevents any radiation of heat. This is because the air openings or passages extending through the middle baffle are not in alignment with the air openings or passages in either the inner baffle or the bottom baffle.

The present invention also significantly minimizes the transfer of heat by conduction. This is accomplished through using only sixteen screws to hold the baffles and the heat shield in position. Furthermore, the spacing between the three baffles is accomplished by employing tabs having only substantially point contacts with the surface of any baffle that they engage.

A further minimizing of heat transfer by conduction is obtained through having very small contact areas between the bottom baffle and the inner baffle. The bottom and inner baffles are joined to each other by tabs on the rear of the inner baffle having only edge contact with an edge of each slot in the bottom baffle and by two of the sixteen screws at the front of the two baffles with dimples being utilized to space most of the front of the bottom baffle from the inner baffle.

The baffle assembly of the present invention exceeds the ANSI requirement by about 50° F. Therefore, the storage compartment of a self-cleaning gas rainge of the present invention has a maximum temperature of only about 250° F. with an ambient temperature of 72° F.

An object of this invention is to provide a self-cleaning gas range having a unique baffle assembly.

Another object of this invention is to provide a less costly baffle assembly for a self-cleaning gas range.

A further object of this invention is to provide a self-cleaning gas range with no insulation in the area of the baffle assembly.

Other objects of this invention will be readily perceived from the following description, claims, and drawings.

BRIEF DESCRIPTION OF THE DRAWINGS

The attached drawings illustrate a preferred embodiment of the invention, in which.

DESCRIPTION OF THE PREFERRED EMBODIMENT

Figure 1:
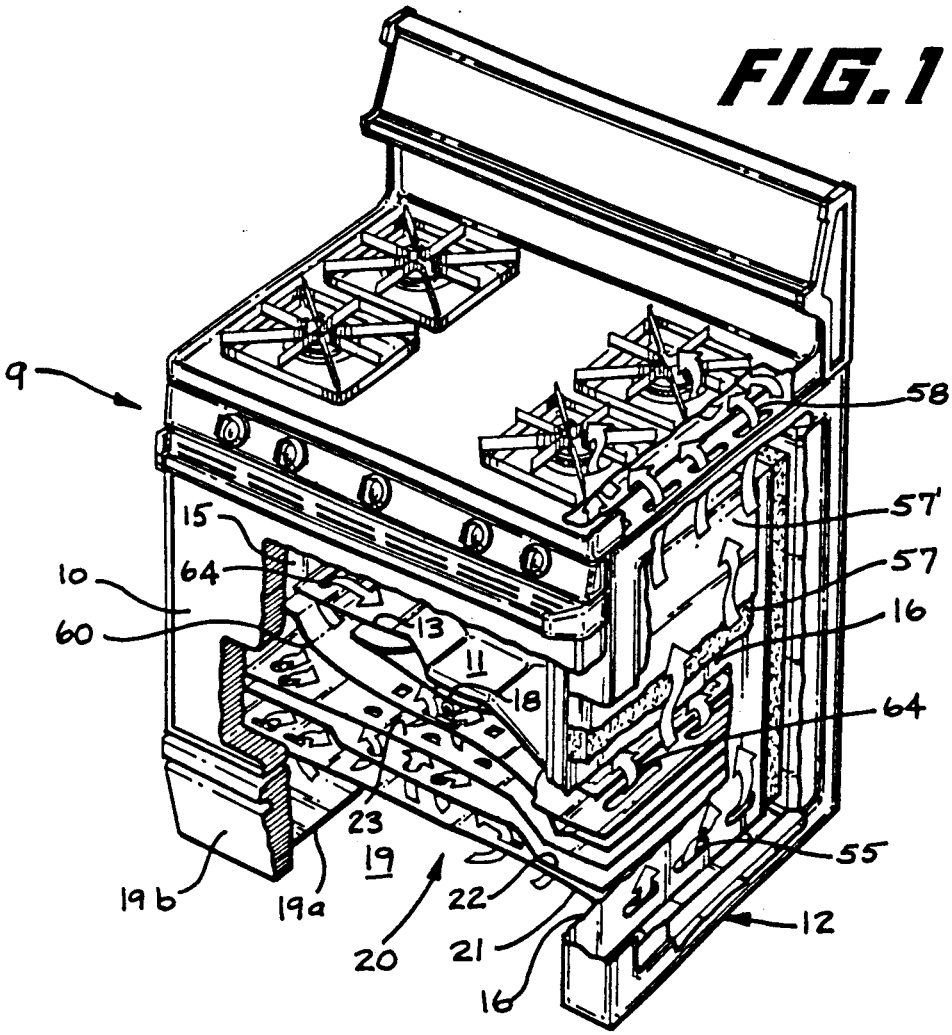
FIG. 1 is a perspective view of a self-cleaning gas range with portions of the self-cleaning gas range removed for clarity purposes.

Referring to the drawings and particularly FIG. 1, there is shown a self-cleaning gas range 9 having a hinged door 10 for closing a front access opening to an oven 11 (see FIG. 3) supported by a frame 12. The oven 11 includes a bottom wall 13, a back wall 14, and substantially parallel side walls 15 (see FIG. 2) and 16. Each of the back wall 14 (see FIG. 3) and the side walls 15 and 16 (see FIG. 2) has a portion extending downwardly beyond the bottom wall 13. A mounting brace 17 (see FIG. 3), which extends between the side walls 15 and 16 (see FIG. 2), has a pair of vertical mounting flanges **17*a* (see FIG. 4) at its ends with two holes 17*b* in each of the mounting flanges 17*a* to receive screws 17*c* (see FIG. 3) for attaching the mounting brace 17 to the side walls 15 and 16 (see FIG. 2**).

A gas burner 18 (see FIG. 3) is disposed beneath the bottom wall 13 of the oven 11 and has gas supplied thereto. When self cleaning of the oven 11 is to occur, the gas burner 18, which also is employed during cooking, heats the oven 11, which has a second burner (not shown) at its top for broiling, for a sufficient period of time to produce self cleaning. When self cleaning of the oven 11 is occurring, it is desired to maintain the top of a storage compartment 19, which is disposed beneath the burner 18 in spaced relation thereto and has a storage drawer **19*a* slidably supported therein, at a temperature no greater than a predetermined maximum temperature with respect to the ambient temperature. The storage compartment 19 has its front access opening closed by a front wall 19*b* (see FIG. 1) of the storage drawer 19*a***.

A baffle assembly 20 (see FIG. 3), which is supported between the gas burner 18 and the storage compartment 19, includes a bottom baffle 21, which forms the top of the storage compartment 19 and is maintained below a predetermined maximum temperature. Air flow through the baffle assembly 20 provides air for combustion to the gas burner 18 while also cooling the baffle assembly 20 to aid in maintaining the bottom baffle 21 at a temperature no greater than a predetermined maximum temperature.

In addition to the bottom baffle 21, the baffle assembly 20 includes a intermediate or middle baffle 22 disposed in vertical spaced relation to the bottom baffle 21 and an inner or top baffle 23 disposed in vertical spaced relation above the intermediate baffle 22. Each of the baffles 21 and 22 is formed of galvanized steel so as to reflect heat, and the inner baffle 23 is formed of reflecting aluminum and preferably has a thickness of 0.050". The bottom baffle 21 preferably has a thickness of 0.024", and the intermediate baffle 22 preferably has a thickness of 0.018".

Figure 6:
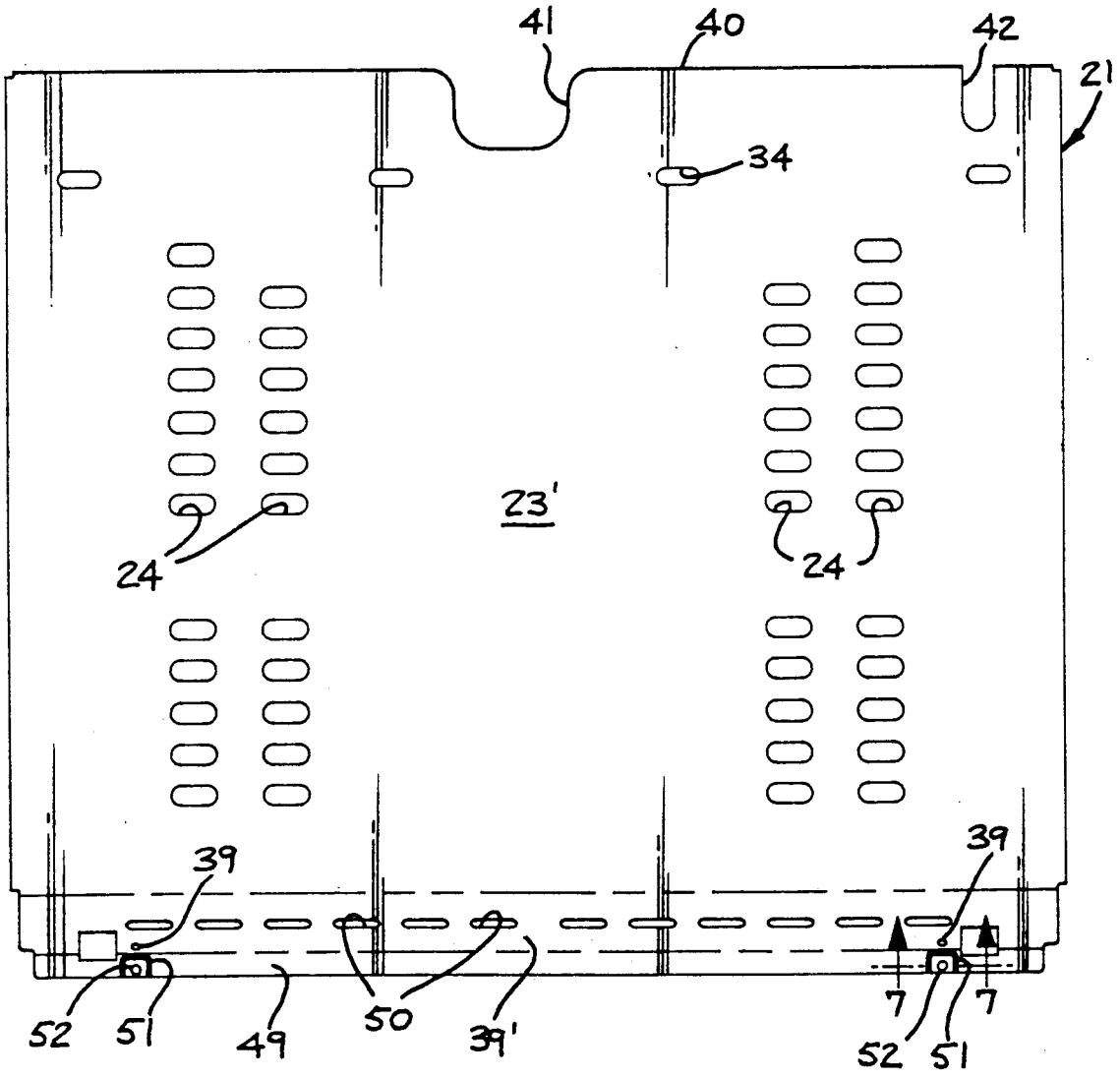
FIG. 6 is a top plan view of a bottom baffle of the baffle assembly.

As shown in FIG. 6, the bottom baffle 21, which has a main substantially planar portion 23', has substantially rectangular shaped air passages 24 extending therethrough in four separate rows with two of the rows being substantially spaced from the other two rows. Thus, air can flow from beneath the bottom baffle 21 through the air passages 24 to the top of the bottom baffle 21.

Figure 9:
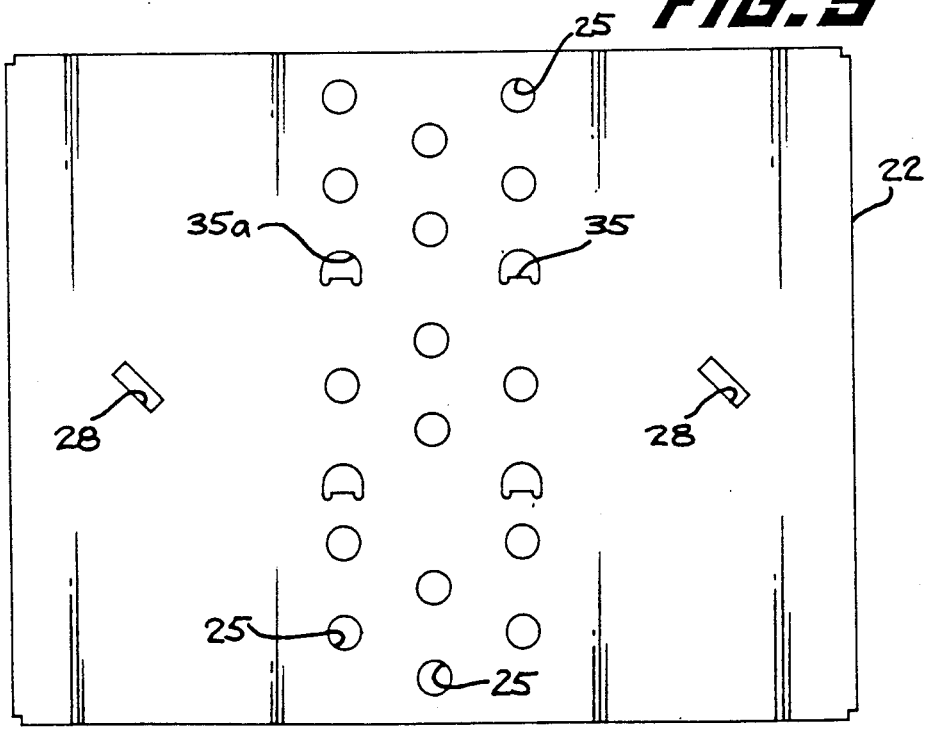
FIG. 9 is a top plan view of an intermediate baffle of the baffle assembly.

The intermediate baffle 22 (see FIG. 9), which is substantially planar, has three rows of circular shaped air passages 25 extending therethrough. The air passages 25 are disposed in the central portion of the intermediate baffle 22.

Figure 10:
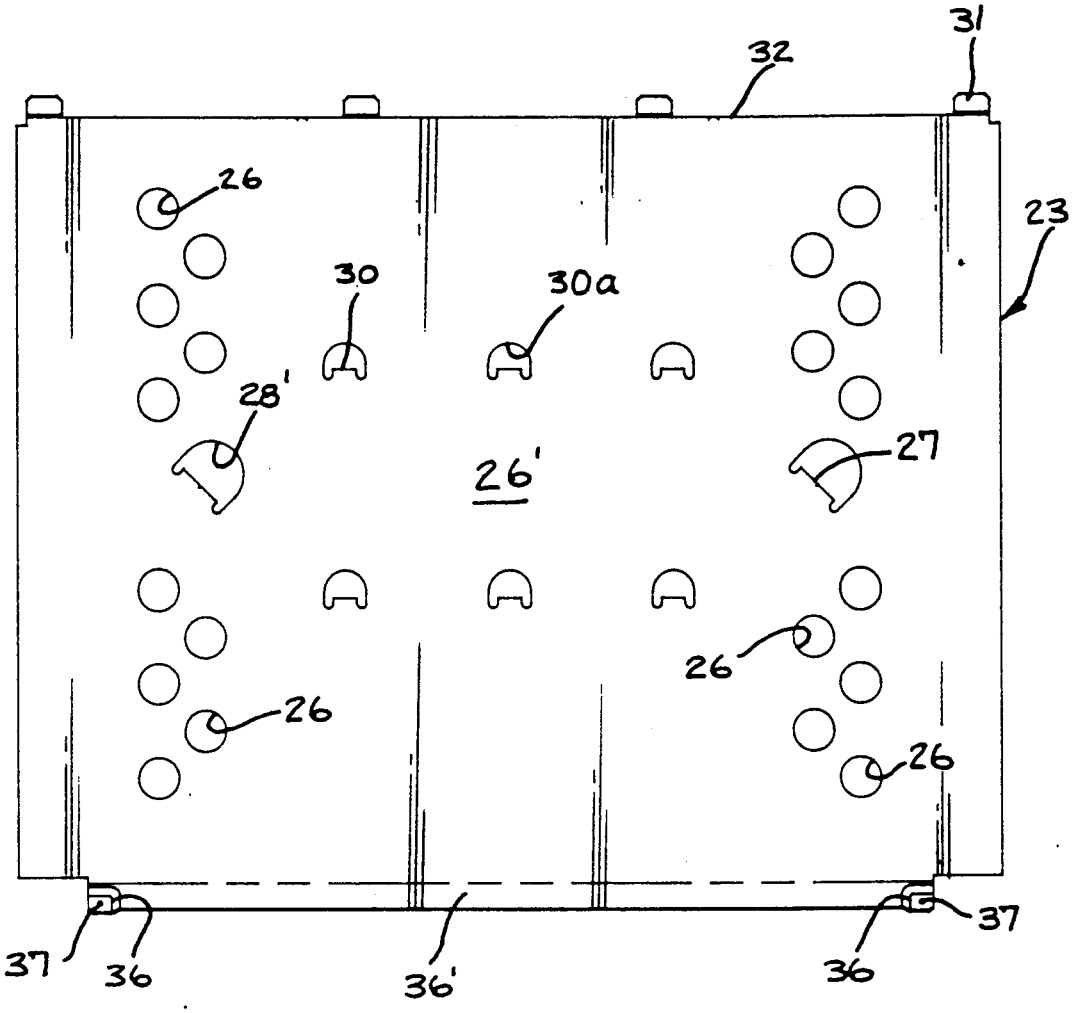
FIG. 10 is a top plan view of an inner baffle of the baffle assembly.

When the three baffles 21 (see FIG. 3), 22, and 23 are assembled, the air passages 25 (see FIG. 9) are not aligned with any of the air passages 24 (see FIG. 6) in the bottom baffle 21. Likewise, when the three baffles 21 (see FIG. 3), 22, and 23 are assembled, the air passages 25 (see FIG. 9) in the intermediate baffle 22 are not in alignment with any of four rows of circular shaped air passages 26 (see FIG. 10) in a main substantially planar portion 26' of the inner or top baffle 23. The four rows of the air passages 26 are arranged in two spaced pairs of rows.

Figure 11:
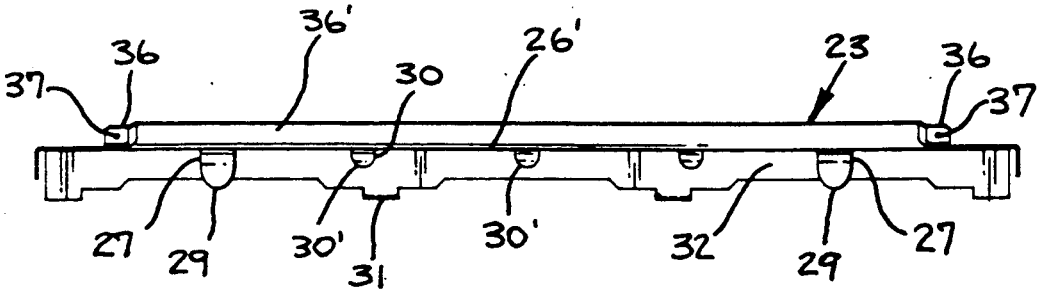
FIG. 11 is a front elevational view of the inner baffle of FIG. 10.

The inner baffle 23 has two tabs 27 (see FIG. 11) extending downwardly therefrom for passing through two rectangular shaped openings 28 (see FIG. 9) in the intermediate baffle 22 to maintain the air passages 26 (see FIG. 10) in the inner baffle 23 out of alignment with the air passages 25 (see FIG. 9) in the intermediate baffle 22. Each of the two tabs 27 (see FIG. 11), which are lanced from the main substantially planar portion 26' (see FIG. 10) of the inner baffle 23 to create openings 28', has an arcuate or curved bottom surface 29 (see FIG. 11)engaging the top of the bottom baffle 21 (see FIG. 3) in a substantially point contact to space the main substantially planar portion 26' of the inner baffle 23 from the bottom baffle 21. The substantially point contacts produce a minimum heat transfer area. This arrangement also insures that the air passages 24 (see FIG. 6) in the bottom baffle 21 are not in alignment with the passages 25 (see FIG. 9) in the intermediate baffle 22 when the baffles 21 (see FIG. 3), 22, and 23 are assembled together as the baffle assembly 20.

The main substantially planar portion 26' (see FIG. 10) of the inner baffle 23 also has six tabs 30 extending downwardly therefrom with each of the tabs 30, which are lanced from the main substantially planar portion 26' of the inner baffle 23 to create openings **30*a* therein, having an arcuate or curved bottom surface 30' (see FIG. 11) for engaging the top of the intermediate baffle 22 (see FIG. 9) to not only space the inner baffle 23 (see FIG. 10) from the intermediate baffle 22 (see FIG. 9) but also to have only substantially point contact therewith. This minimizes heat conduction between the intermediate baffle 22 and the inner baffle 23 (see FIG. 10**).

The inner baffle 23 has four tabs 31 extending downwardly and outwardly from its rear wall 32. Each of the tabs 31 is disposed within one of four rectangular shaped slots 34 (see FIG. 6) in the main substantially planar portion 23' of the bottom baffle 21. Thus, each of the tabs 31 (see FIG. 10) has only an edge contact with the bottom baffle 21 (see FIG. 6) when the tab 31 (see FIG. 10) passes through the slot 34 (see FIG. 6) in the bottom baffle 21. This provides a minimum heat transfer area.

The intermediate baffle 22 (see FIG. 9) is maintained in spaced relation to the bottom baffle 21 (see FIG. 6) by four tabs 35 (see FIG. 9) extending downwardly from the intermediate baffle 22 and having an arcuate or curved bottom surface 35' (see FIG. 2) engaging the top of the bottom baffle 21. The arcuate or curved bottom surface 35' of each of the four tabs 35, which are lanced from the intermediate baffle 22 (see FIG. 9) to create openings **35*a* therein, provides only a substantially point contact with the bottom baffle 21 (see FIG. 2). This minimizes heat conduction between the bottom baffle 21 and the intermediate baffle 22**.

Figure 12:
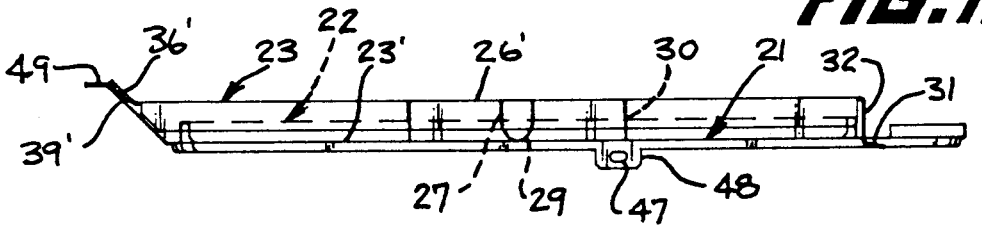
FIG. 12 is a side elevational view of the three baffles of the baffle assembly.
Figure 13:
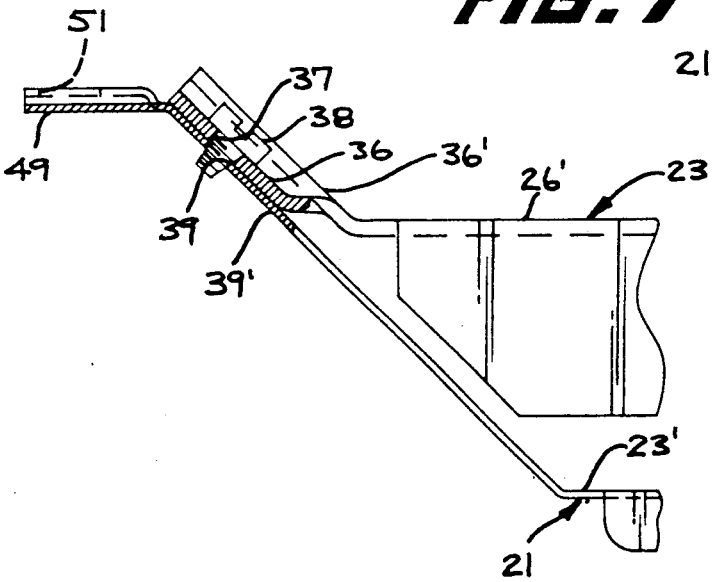
FIG. 13 is an enlarged fragmentary side elevational view, partly in section, of portions of the inner and bottom baffles and showing their front connecting arrangement.

It should be understood that the openings **35*a* (see FIG. 9) in the intermediate baffle 22 are not in alignment with the air passages 24 (see FIG. 6) in the bottom baffle 21 or the air passages 26 (see FIG. 10), the openings 28', or the openings 30*a* in the inner baffle 23. It also should be understood that the openings 28' and 30*a* in the inner baffle 23 are not aligned with the air passages 25 (see FIG. 9) in the intermediate baffle 22. In addition to the tabs 31 (see FIG. 12) on the inner baffle engaging the bottom baffle 21 to connect the bottom baffle 21 and the inner baffle 23, the inner baffle 23 also has its front end connected to the bottom baffle 21. This connection includes two standoffs 36 (see FIG. 10), which are depressed portions in a front angular portion 36' of the top baffle 23. As shown in FIG. 13, the front angular portion 36' is at an angle of about 45° to the vertical and extends from the front of the main substantially planar portion 26' of the inner baffle 23**.

Each of the standoffs 36 has a hole 37 extending therethrough to receive a screw 38 for extending through a hole 39 in an angular portion 39' of the bottom baffle 21. Thus, there are only two substantially point contacts between the bottom baffle 21 and the inner baffle 23 at the front of the inner baffle 23 because of the standoffs 36.

The bottom baffle 21 is supported by the oven 11 (see FIG. 3) and the frame 12 of the self-cleaning gas range 9. The bottom baffle 21 (see FIG. 6) has its rear edge 40 engaging the back wall 14 (see FIG. 3) of the oven 11 except for two notches 41 (see FIG. 6) and 42. The notch 41 is to enable a portion 43 (see FIG. 3) of the gas burner 18 to pass through the bottom baffle 21 with a close fit, and the notch 42 (see FIG. 6) is for a gas line (not shown), which supplies gas to the gas burner 18 (see FIG. 3), to pass through the bottom baffle 21 with a close fit.

The bottom baffle 21 has the rear of its bottom surface resting on tabs 45 (one shown in FIG. 3) extending from brackets 45' mounted on the portion of the back wall 14 of the oven 11 extending downwardly beyond the bottom wall 13 of the oven 11. The bottom baffle 21 is secured to the side wall 15 of the oven 11 by a screw 46 extending through a hole 47 (see FIG. 12) in a tab 48 extending downwardly from the main substantially planar portion 23' of the bottom baffle 21. There is a similar connection between the side wall 16 (see FIG. 2) of the oven 11 and the other side of the bottom baffle 21.

As shown in FIG. 13, a horizontal portion 49 extends forward from the angular portion 39' of the bottom baffle 21. The angular portion 39' has air passages 50 (see FIG. 6) extending therethrough.

The air passages 50 aid in cooling the front end of the bottom baffle 21. The air passages 50 also decrease the total area of the angular portion 39' of the bottom baffle 21 to reduce the heat transfer by conduction to the substantially planar portion 23' of the bottom baffle 21.

Figure 7:
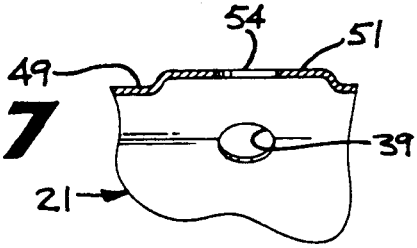
FIG. 7 is an enlarged fragmentary sectional view of a portion of the bottom baffle of FIG. 6 and taken along line 7-7 of FIG. 6.

The horizontal portion 49 of the bottom baffle 21 has two standoffs 51, which are raised portions as shown in FIG. 7, for making substantially point contacts with a horizontal flange 52 (see FIG. 3) of a front wall 53 of the frame 12. Each of the standoffs 51 (see FIG. 7) has a hole 54 to receive a screw (not shown) for connecting the front of the bottom baffle 21 to the horizontal flange 52 (see FIG. 3) of the front wall 53 of the frame 12.

Thus, the bottom baffle 21 provides a barrier to air flow therethrough except through the air passages 24 (see FIG. 6) in the main substantially planar portion 23' and the air passages 50 in the angular portion 39'. Air also is caused to flow beneath the bottom surface of the bottom baffle 21 by each of the side walls 15 (see FIG. 2) and 16 having three louvered openings 55 (see FIGS. 3 and 5) extending therethrough in a substantially horizontal plane slightly beneath the bottom baffle 21.

Each of the three openings 55 in each of the side walls 15 and 16 communicates with a vertically extending air passage 56 (see FIG. 5) exterior of each of the side walls 15 and 16. A U-shaped fiberglass insulation 57 extends around the top of the oven 11 and along the side walls 15 and 16 of the oven 11. A U-shaped sheet metal wrap 57' overlies the exterior of the insulation 57, and the portions of the wrap 57' parallel to the side walls 15 and 16 are spaced from the frame 12 to provide the air passages 56 therebetween.

The top of the air passage 56 exterior of the side wall 16 of the oven 11 communicates with the exterior of the self-cleaning gas range 9 (see FIG. 1) through openings 58 in the top of the self-cleaning gas range 9. The top of the air passage 56 (see FIG. 5) exterior of the side wall 15 of the oven 11 similarly communicates with the exterior of the self-cleaning gas range 9. This enables air to flow beneath the bottom baffle 21 through the openings 55 into the passages 56 exterior of each of the side walls 15 and 16.

Figure 3:
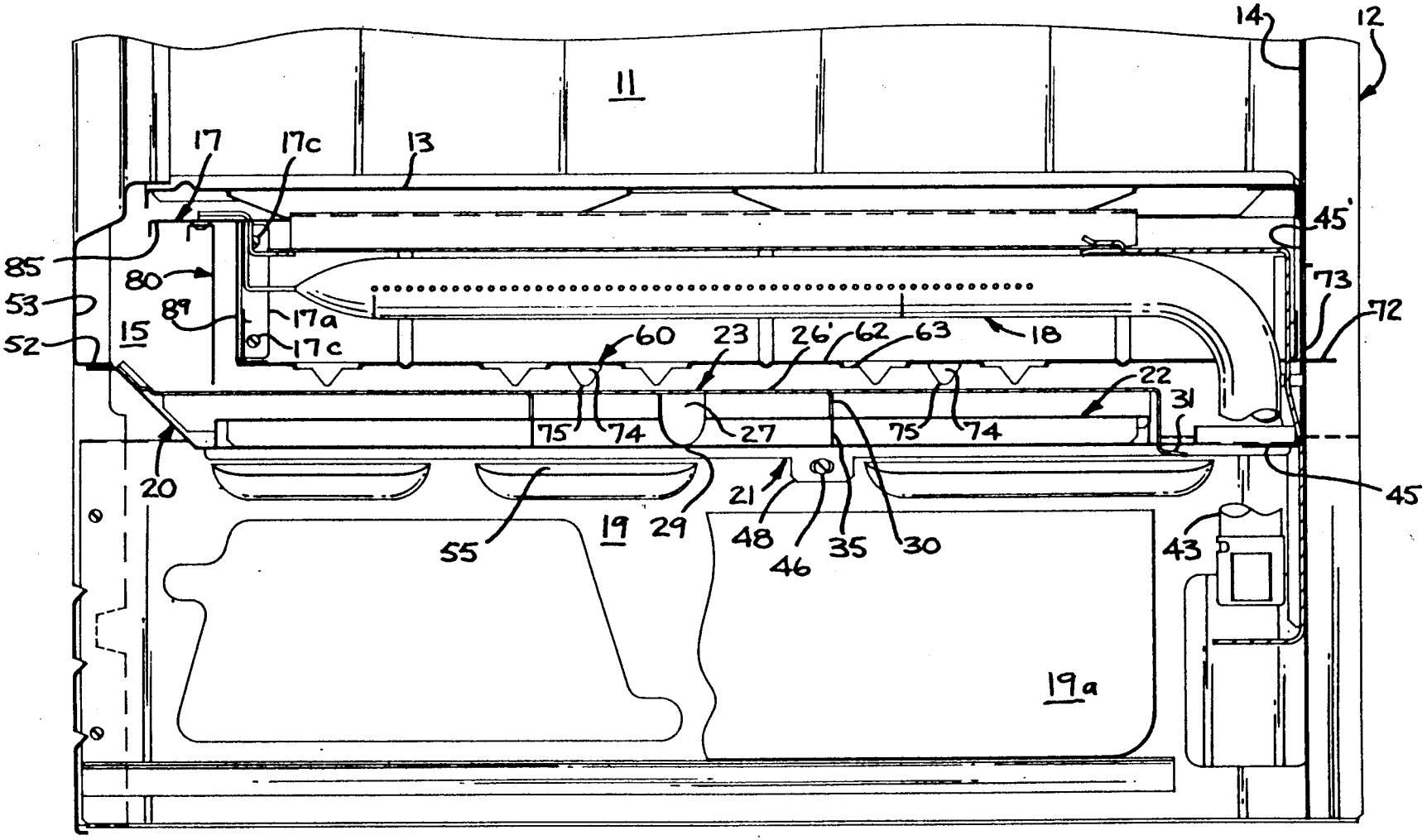
FIG. 3 is a side elevational of a portion of an oven of the self-cleaning gas range of FIG. 1.
Figure 16:
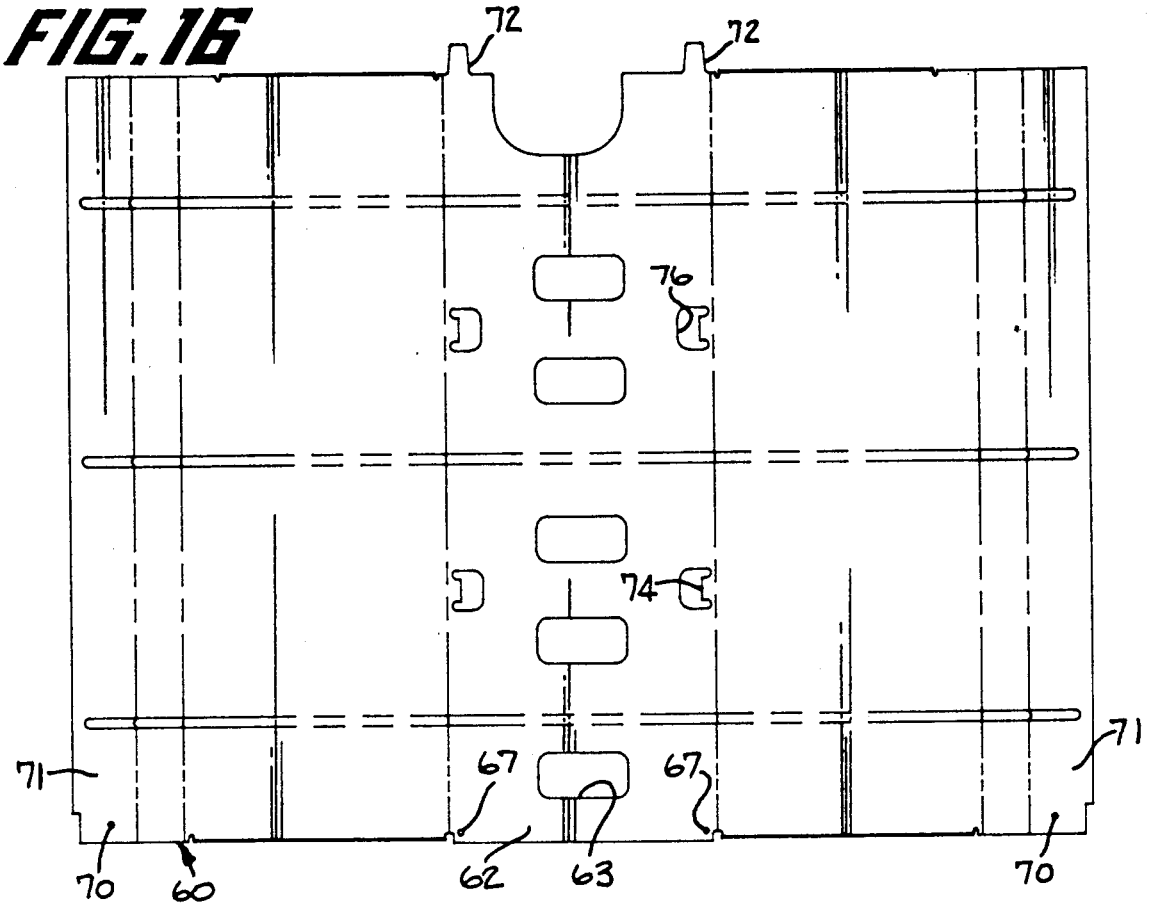
FIG. 16 is a top plan view of a heat shield.

As shown in FIG. 3, a heat shield 60, which is formed of aluminum coated low carbon steel preferably with a thickness of 0.040", is disposed above the inner baffle 23 and below the bottom wall 13 of the oven 11. The heat shield 60, which extends forward of the front of the burner 18, has a flat middle portion 62 with five openings 63 (see FIG. 16) therein to enable the air flowing through the air passages 26 (see FIG. 5) in the top baffle 23 to flow past the burner 18 to aid in combustion and then through openings 64 in the bottom wall 13 of the oven 11 into the interior of the oven 11.

Figure 14:
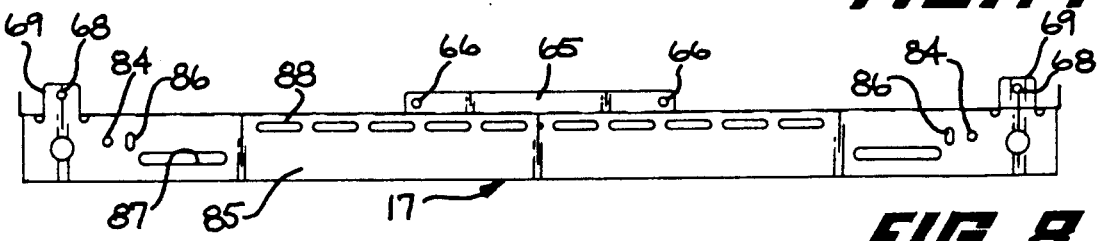
FIG. 14 is a top plan view of a mounting brace of the self-cleaning gas range of FIG. 1.
Figure 8:
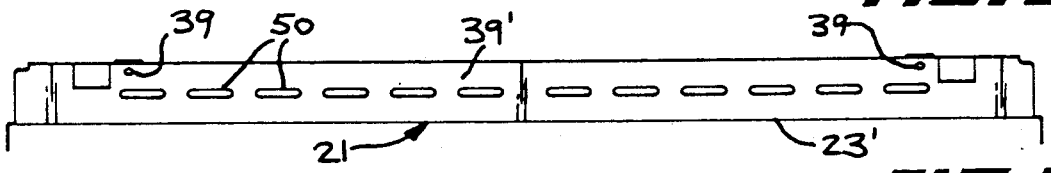
FIG. 8 is a front elevational view of the bottom baffle of FIG. 6.

The heat shield 60 is supported on a bottom mounting flange 65 (see FIG. 14) of the mounting brace 17, which extends between the side walls 15 (see FIG. 2) and 16 of the oven 11, and by the back wall 14 (see FIG. 3) of the oven 11. As shown in FIG. 14, the mounting flange 65 of the mounting brace 17 has two holes 66 to receive screws (not shown) passing into two holes 67 (see FIG. 16) in the front edge of the flat middle portion 62 of the heat shield 60. The mounting brace 17 (see FIG. 14) also has two holes 68 in a pair of upper mounting flanges 69 to receive screws (not shown) passing into holes 70 (see FIG. 16) in two outer flat portions 71 of the heat shield 60.

The heat shield 60 has a pair of tabs 72 extending rearwardly from the flat middle portion 62. The tabs 72 are disposed within slots 73 (see FIG. 3) in the back wall 14 of the oven 11 for support of the heat shield 60 by the back wall 14 of the oven 11.

The flat middle portion 62 of the heat shield 60 also has four tabs 74 extending downwardly therefrom. Each of the tabs 74 has an arcuate of curved bottom surface 75. If there should be expansion of the flat middle portion 62 of the heat shield 60 or the inner baffle 23 due to the high temperature created during self cleaning of the oven 11, the curved bottom surface 75 of each of the tabs 74 would engage the inner baffle 23 in a substantially point contact.

The total area of the openings 63 (see FIG. 16) in the heat shield 60 and openings 76 in the heat shield 60 created by lancing the tabs 74 therefrom and the total area of the air passages 24 (see FIG. 6) and 50 in the bottom baffle 21 are critical to insure that sufficient air is available for combustion at the gas burner 18 (see FIG. 3). The total area of the openings 63 (see FIG. 16) and 76 in the heat shield 60 must be less than the total area of the openings 64 (see FIG. 5) in the bottom wall 13 of the oven 11 as must the total area of the air passages 24 and 50 (see FIG. 6) in the bottom baffle 21.

It should be understood that the function of tabs 27 (see FIG. 3), 30, and 35 is to insure that the baffles 21, 22, and 23 remain spaced when subjected to the high operating temperatures typically associated with self cleaning of the oven 11, which can cause warping of the baffles. Retaining the spacing between these baffles is important not only for purposes of heat management, e.g. to limit heat transfer by conduction from baffle to baffle, and maintain air flow for convection cooling of he baffles, but also to maintain a sufficient air flow path for combustion air for burner 18. Tabs 27, 30, and 35 not only provide reliable spacing structure but do so with only substantially point contact thereby minimizing conduction. As best seen in FIG. 3, tabs 30 and 35 are aligned front to back to enhance the structural integrity of the spacing structure. However, the tabs are misaligned side to side so that the associated openings resulting from the lancing of the tabs are not in vertical alignment thereby preventing radiant heating of the storage area 19 through such openings.

Figure 4:
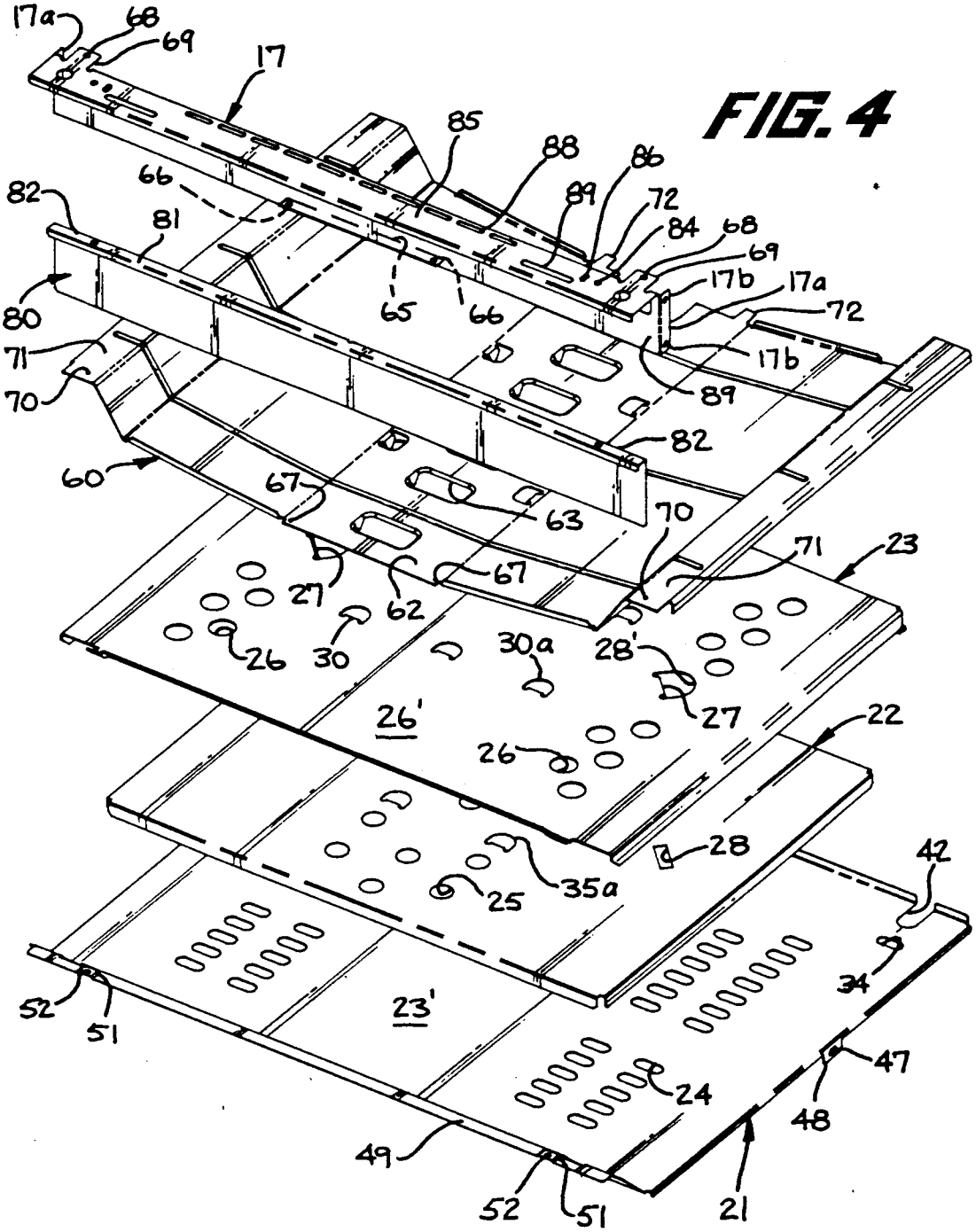
FIG. 4 is an exploded perspective view of three baffles of a baffle assembly, a heat shield, a radiation shield, and a mounting brace used in the self-cleaning gas range of FIG. 1.
Figure 15:
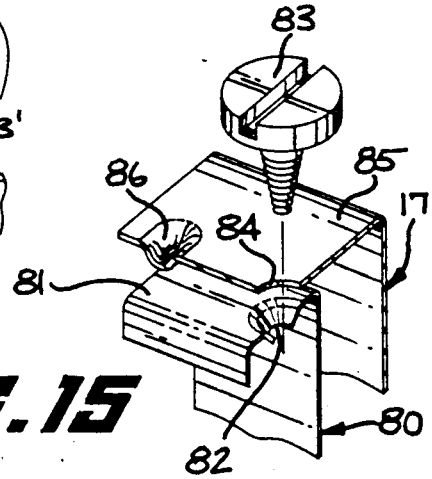
FIG. 15 is an enlarged perspective view, partly in section, of a portion of a vertically disposed radiation shield mounted on a portion of the mounting brace of FIG. 13.

A vertically disposed heat radiation shield 80 (see FIG. 3) is supported by the mounting brace 17 and extends downwardly therefrom. As shown in FIG. 4, the heat radiation shield 80, which is formed of an aluminum alloy and preferably has a thickness of 0.018", has a flat mounting portion 81 with two holes 82 therein. Screws 83 (see FIG. 15) extend through two holes 84 (see FIG. 14) in a flat portion 85 of the mounting brace 17 prior to passing into the holes 82 (see FIG. 15) in the heat radiation shield 80.

The flat portion 85 (see FIG. 14) of the mounting brace 17 has a dimple 86 located adjacent each of the holes 84 contacting the flat mounting portion 81 (see FIG. 15) of the heat radiation shield 80. These provide the only contacts of the heat radiation shield 80 with the mounting brace 17.

As shown in FIG. 14, the flat portion 85 of the mounting brace 17 has two large slots 87 adjacent its front edge and a plurality of slots 88 adjacent its rear edge. The slots 87 and 88 allow air flow therethrough to aid in cooling the mounting brace 17, which has a vertical portion 89 (see FIG. 3) adjacent the front of the gas burner 18. The slots 87 (see FIG. 14) and 88 also reduce the area of the mounting brace 17 to decrease heat transfer by conduction.

The radiation shield 80 eliminates the need for insulation in the front wall 53 of the frame 12. Since the use of the insulation in the front wall 53 of the frame 12 would reduce air flow, the use of the radiation shield 80 enables increased air flow.

Figure 2:
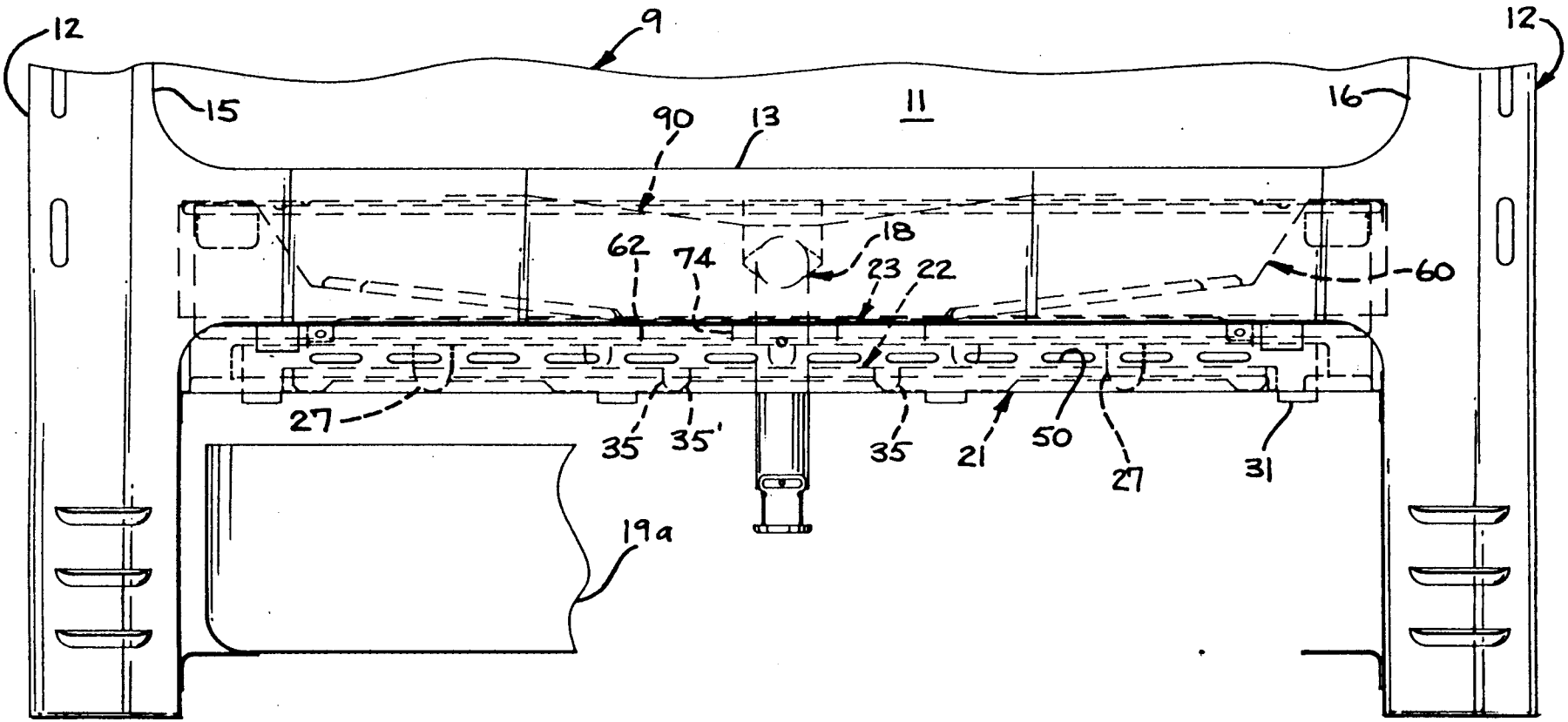
FIG. 2 is a front elevational view of a portion of an oven of the self-cleaning gas range of FIG. 1.

As shown in FIG. 2, a flame spreader 90 is disposed beneath the bottom wall 13 of the oven 11 to spread the flame from the gas burner 18. The flame spreader 90, which is formed of an aluminum coated low carbon steel, is supported on the gas burner 18.

Figure 5:
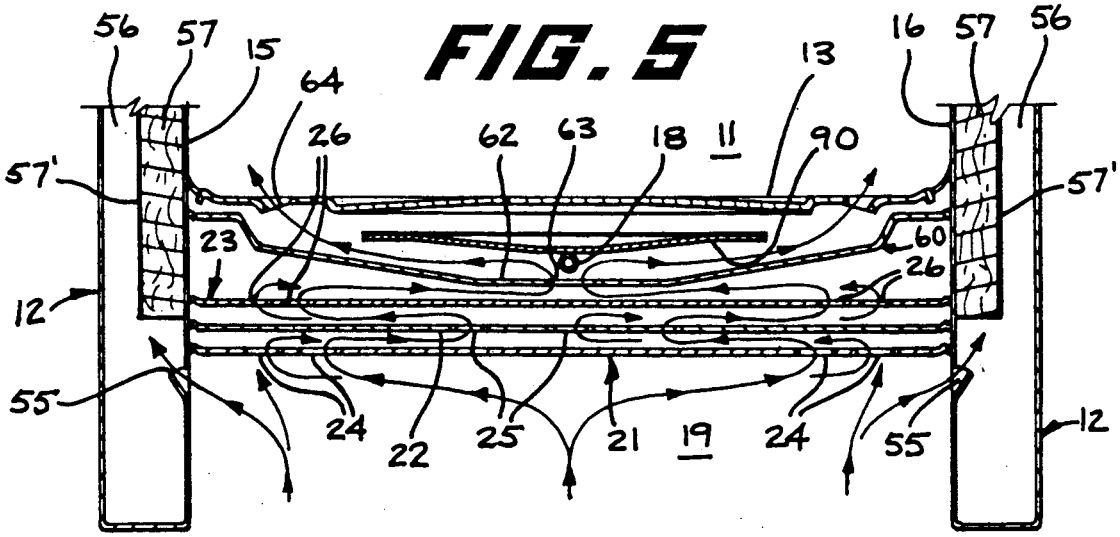
FIG. 5 is a schematic front sectional view of a portion of the self-cleaning gas range of FIG. 1.

The convection cooling of the baffle structure is most clearly illustrated in the schematic view of the oven 11 and baffle structure in FIG. 5. The circuitous air flow path through the baffle structure is illustrated by the arrows in FIG. 5 and also in FIG. 1. When the gas burner 18 is ignited for baking or self cleaning, air from storage area 19 flows along the bottom surface of bottom baffle 21 to and through the air passages 24 in the bottom baffle 21, into the region between baffle 21 and intermediate baffle 22. In this region the cooling air sweeps the opposing surfaces of baffles 21 and 22 en route to openings 25 in intermediate baffle 22. The cooling air then passes through openings 25 into the region between baffle 22 and inner baffle 23, sweeping the opposing surfaces of baffles 22 and 23 en route to openings 26. Air passing through openings 26 sweeps over the upper surface of baffle 23 as it is drawn toward openings 63 in heat shield 60 en route to burner 18. In addition to the primary air flow paths illustrated schematically in FIG. 5, it will be appreciated that some air flow also occurs through the various openings in the baffles resulting from the lancing of the various spacing tabs.

The convection cooling of the bottom surface of bottom baffle 21, is enhanced by the chimney effect of the air passages in the side walls of the range between the oven side walls and the frame, which causes a portion of the cooling air from storage area 19 to be drawn through louvered openings 55 formed in each of the side walls 15 and 16 into the air passages 56 exterior of the side walls 15 and 16 and insulation wrap 57. The circuitous air flow paths illustrated in FIG. 5 provides substantial convective cooling of the baffles contributing significantly to the substantial temperature drop over the relatively short vertical distance achieved with this baffle structure. This convective cooling arrangement, the substantially point contact between the baffles which reduces conductive heat transfer, and the non-alignment of the various openings in the baffles which blocks radiant heat transfer, all contribute to maintaining the storage compartment temperature below a predetermined maximum temperature.

One advantage of this invention is that through the compact arrangement of the baffles 21, 22, and 23 of the baffle assembly 20, the total height from the bottom baffle 21 to the bottom wall 13 of the oven 11 is nominally 4⅜, which is substantially shorter than that of other ranges known in the art permitting a larger oven capacity within the same external range dimensions. Another advantage of the invention is a less expensive baffle assembly for a self-cleaning gas range. Yet another advantage is a potentially more energy efficient range in that heat loss by conduction is reduced by having only substantially point contacts between the baffles of the baffle assembly, and heat loss by radiation is reduced by the non-alignment of the air passages in the reflective baffles and the heat shield.

For purposes of exemplification, a particular embodiment of the invention has been shown and described herein according to the best present understanding thereof. However, it will be apparent that changes and modifications in the arrangement and construction of the parts thereof may be resorted to without departing from the spirit and scope of the invention. It is therefore to be understood that the appended claims are intended to cover all such changes and modifications.

We claim:

1. A self-cleaning gas range including:

frame means;

an oven supported by said frame means;

said oven including a bottom wall having openings therein;

a storage compartment disposed beneath said oven in spaced relation thereof;

burner means disposed beneath said bottom wall of said oven and above said storage compartment for heating said oven to a temperature to produce self cleaning of said oven;

a heat shield beneath said burner means;

said heat shield having air passages extending therethrough; a baffle assembly disposed between said heat shield and said storage compartment for maintaining the temperature of said storage compartment no greater than a predetermined maximum temperature relative to the ambient temperature when said burner means is causing self cleaning of said oven;

and said baffle assembly including:

a bottom baffle disposed adjacent the top of said storage compartment;

an intermediate baffle disposed above said bottom baffle and in spaced relation to said bottom baffle;

an inner baffle disposed above said intermediate baffle and in spaced relation to said intermediate baffle;

assembling means for assembling said bottom baffle, said intermediate baffle, and said inner baffle together;

each of said bottom baffle, said intermediate baffle, and said inner baffle having air passages extending therethrough;

cooperating means for cooperating with at least said intermediate baffle to position said intermediate baffle horizontally relative to said bottom baffle and said inner baffle to prevent alignment of said air passages in said intermediate baffle with said air passages in said bottom baffle and said air passages in said inner baffle so that air flows from beneath said bottom baffle through said air passages in each of said bottom baffle, said intermediate baffle, and said inner baffle in a circuitous path and through said air passages in said heat shield to said burner means;

at least one of said bottom baffle, said intermediate baffle, and said inner baffle having enabling means for enabling attachment of said baffle assembly to said frame means for support of said baffle assembly by said frame means;

said inner baffle including a heat reflecting material for reflecting heat from said burner means;

and said bottom baffle having at least its upper surface formed of a heat reflecting material.

2. The self-cleaning gas range according to claim 1 including a vertically disposed radiation shield disposed forward of said burner means and above said inner baffle.

3. The self-cleaning gas range according to claim 2 in which said intermediate baffle includes engaging means for engaging said bottom baffle to dispose said intermediate baffle in vertical spaced relation to said bottom baffle, said engaging means providing only substantially point contacts between said intermediate baffle and said bottom baffle.

4. The self-cleaning gas range according to claim 3 in which said inner baffle includes:

first spacing means for spacing said inner baffle in vertical spaced relation to said intermediate baffle, said first spacing means having only substantially point contacts with said intermediate baffle;

and second spacing means for spacing said inner baffle in vertical spaced relation to said bottom baffle, said second spacing means having only substantially point contacts with said bottom baffle.

5. The self-cleaning gas range according to claim 4 in which:

said second spacing means of said inner baffle includes a plurality of tabs extending downwardly from said inner baffle;

and each of said tabs has a curved bottom surface for engaging said bottom baffle in a substantially point contact.

6. The self-cleaning gas range according to claim 5 in which:

said intermediate baffle has a plurality of slots equal in number to said tabs extending from said inner baffle and engaging said bottom baffle;

and each of said tabs extends through one of said slots in said intermediate baffle and cooperates therewith to comprise said cooperating means.

7. The self-cleaning gas range according to claim 6 in which:

said engaging means of said intermediate baffle includes a plurality of tabs extending downwardly from said intermediate baffle;

and each of said tabs extending downwardly from said intermediate baffle has a curved bottom surface for engaging said bottom baffle in a substantially point contact.

8. The self-cleaning gas range according to claim 7 in which said assembling means includes:

first connecting means for connecting the rear of said bottom baffle and the rear of said inner baffle to each other in edge contact;

and second connecting means for connecting the front of said bottom baffle and the front of said inner baffle to each other in substantially point contacts.

9. The self-cleaning gas range according to claim 8 in which said first connecting means includes:

a plurality of tabs extending from one of said inner baffle and said bottom baffle at its rear towards the other of said inner baffle and said bottom baffle;

and a plurality of slots in the other of said inner baffle and said bottom baffle to receive said tabs in edge contact;

and said second connecting means includes:

two standoffs on one of said inner baffle and said bottom baffle adjacent the front and engaging the other of said inner baffle and said bottom baffle to provide substantially point contacts therebetween;

and securing means holding each of said two standoffs against the other of said inner baffle and said bottom baffle.

10. The self-cleaning gas range according to claim 9 in which each of said bottom baffle and said intermediate baffle is formed of galvanized steel.

11. The self-cleaning gas range according to claim 10 in which said inner baffle is formed of reflecting aluminum.

12. The self-cleaning gas range according to claim 1 in which said intermediate baffle includes engaging means for engaging said bottom baffle to dispose said intermediate baffle in vertical spaced relation to said bottom baffle, said engaging means providing only substantially point contacts between said intermediate baffle and said bottom baffle.

13. The self-cleaning gas range according to claim 12 in which said inner baffle includes:

first spacing means for spacing said inner baffle in vertical spaced relation to said intermediate baffle, said first spacing means having only substantially point contacts with said intermediate baffle;

and second spacing means for spacing said inner baffle in vertical spaced relation to said bottom baffle, said second spacing means having only substantially point contacts with said bottom baffle.

14. The self-cleaning gas range according to claim 13 in which:

said second spacing means of said inner baffle includes a plurality of tabs extending downwardly from said inner baffle;

and each of said tabs has a curved bottom surface for engaging said bottom baffle in a substantially point contact.

15. The self-cleaning gas range according to claim 14 in which:

said engaging means of said intermediate baffle includes a plurality of tabs extending downwardly from said intermediate baffle;

and each of said tabs extending downwardly from said intermediate baffle has a curved bottom surface for engaging said bottom baffle in a substantially point contact.

16. The self-cleaning gas range according to claim 1 in which said assembling means includes:

first connecting means for connecting the rear of said bottom baffle and the rear of said inner baffle to each other in edge contact;

and second connecting means for connecting the front of said bottom baffle and the front of said inner baffle to each other in substantially point contacts.

17. The self-cleaning gas range according to claim 16 in which said first connecting means includes:

a plurality of tabs extending from one of said inner baffle and said bottom baffle at its rear towards the other of said inner baffle and said bottom baffle;

and a plurality of slots in the other of said inner baffle and said bottom baffle to receive said tabs in edge contact;

and said second connecting means includes:

two standoffs on one of said inner baffle and said bottom baffle adjacent the front and engaging the other of said inner baffle and said bottom baffle to provide substantially point contacts therebetween;

and securing means holding each of said two standoffs against the other of said inner baffle and said bottom baffle.

18. The self-cleaning gas range according to claim 1 in which:

said oven has a back wall and a pair parallel side walls connected to said back wall and extending substantially perpendicular thereto, said back wall and said side walls extending downwardly beyond said bottom wall of said oven;

each of said side walls of said oven has vertically extending air passage means exterior thereof;

and each of said side walls of said oven has air communicating means disposed slightly below said bottom baffle of said baffle assembly for allowing air to flow beneath said bottom baffle of said baffle assembly into said air passage means exterior of each of said side walls of said oven.

19. The self-cleaning gas range according to claim 1 including:

said oven having a back wall and a pair of substantially parallel side walls connected to said back wall and extending substantially perpendicular thereto, said back wall and said side walls extending downwardly beyond said bottom wall of said oven;

support means extending between said side walls of said oven beyond said bottom wall of said oven adjacent the front of said side walls and forward of said burner means;

and a vertically disposed radiation shield supported on said support means only by substantially point contacts, said vertically disposed radiation shield being forward of said burner means.

20. The self-cleaning gas range according to claim 1 in which each of said bottom baffle and said intermediate baffle is formed of galvanized steel.

* * * * *